US005894950A

United States Patent [19]

Kick

[11] Patent Number: 5,894,950

[45] Date of Patent: Apr. 20, 1999

[54] ONE-PIECE CLOSURE WITH RE-CLOSABLE BREAK AWAY LID

[75] Inventor: James Kick, St. Louis, Mo.

[73] Assignee: C.A.P.S. Inc., Bridgeton, Mo.

[21] Appl. No.: 08/951,186

[22] Filed: Oct. 15, 1997

[51] Int. Cl.[6] ..... B65D 17/32

[52] U.S. Cl. ..... 220/268; 220/269; 222/153.14; 222/541.6

[58] Field of Search ..... 220/268, 269, 220/270, 711–713, 254, 335, 265, 266, 258, 259; 222/541, 5, 541.9, 541.6, 153.14

[56] References Cited

U.S. PATENT DOCUMENTS

| | | | |
|---|---|---|---|
| D. 286,028 | 10/1986 | DiFede . | |
| D. 319,980 | 9/1991 | Garner . | |
| D. 340,188 | 10/1993 | Forsyth . | |
| D. 350,688 | 9/1994 | Wardell, Jr. . | |
| D. 385,791 | 11/1997 | Forsyth et al. . | |
| 3,738,526 | 6/1973 | Zundel et al. | 220/269 |
| 3,912,128 | 10/1975 | Ziemann et al. . | |
| 3,927,794 | 12/1975 | Erdman | 220/713 X |
| 3,952,914 | 4/1976 | Vogt | 220/269 X |
| 4,200,198 | 4/1980 | West . | |
| 4,489,864 | 12/1984 | Davis . | |
| 4,629,088 | 12/1986 | Durgin | 220/713 X |
| 4,775,065 | 10/1988 | Shastal | 220/269 X |
| 4,969,572 | 11/1990 | vanKerkhoven et al. . | |
| 5,167,338 | 12/1992 | Kick . | |
| 5,299,706 | 4/1994 | Wardell, Jr. . | |
| 5,566,850 | 10/1996 | Forsyth et al. . | |

*Primary Examiner*—Allan N. Shoap
*Assistant Examiner*—Joe Merek
*Attorney, Agent, or Firm*—Polster, Lieder, Woodruff & Lucchesi, LC

[57] ABSTRACT

A one piece closure for a container is described in which the closure has a break-open, reclosable lid. The lid is formed integrally with the closure and is defined by frangible lines of weakness formed in the closure. In use, the lid is initially held in its closed position by way of the unbroken frangible lines of weakness. The user exerts a downward force on the lid so as to break the lid from the closure. The lid is hinged to the closure by means of molded-in-place hinges. The lid has a lid closing tab integrally molded with the lid with the closing tab being disposed on the other side of the hinge line from the lid. As the lid and the closing tab are broken clear of the closure, the lid rotates downwardly about the hinge line into the container and the closing tab rotates upwardly. As the lid move to its fully open position, a locking tab on the bottom face of the lid snap locks into position and cooperates with the closure thus positively holding the lid in its fully open position and preventing the "memory" of the molded in place hinges from partially reclosing the lid. The lid may be re-closed by pushing in the opposite direction on the closing tab thereby to free the locking tab from the closure and to rotate the lid upwardly about the hinge line until the lid and the closing tab are substantially co-planar with the cover.

12 Claims, 2 Drawing Sheets

ONE-PIECE CLOSURE WITH RE-CLOSABLE BREAK AWAY LID

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

This invention relates to an end closure for a shake and pour container, and more particularly, to such a plastic end closure which has a break open frangible lid which, in its initial closed position, seals the container and which, in its subsequent open and reclosable position, controls access to the contents of the container.

Shake and pour containers are well known in the art, and are typically spiral wound paperboard containers with various liners and barriers incorporated therein to protect the product. Alternatively, the container may be molded of a suitable plastic resin or the like. Such containers are often utilized for grated cheese, coffee creamer, or other granular, flowable products. The plastic end closures for these shake and pour containers generally include a cover which is mounted on one end of a canister-type container and which has a frangible, push-open lid which is sealed to the cover when closed. When initially packaged and shipped, the push-open lid forms a tamper-evident seal with the end cover, preventing spillage or spoiling of the product. To open the shake and pour container, pressure is exerted upon the push-open lid, breaking the frangible seal lines forming the perimeter of the lid, and bending it into the container along a molded hinge line. Next, to prevent the product from spilling from the container or from spoiling, a rotatable closure pivotally secured to the cover is rotated to a closed position covering the opening formed by the lid. To dispense the product, the rotatable closure typically contains openings or gratings which may alternately be aligned with the push-open lid opening, thereby allowing the product to be dispensed from the shake and pour container at a controlled rate. Alternatively, a second hinged lid cover is provided which snaps securely in place over the opening formed by the push-open lid. When the product is to be dispensed from containers having this type of end closure, the second lid is unsnapped and bent upward, exposing the push-open lid opening and allowing the product to be poured or shaken out.

However, with such prior art plastic end closures, the molded in place hinge line of the push-open lid has a "memory" such that after the initial opening of the push-open lid, the lid tends to spring back at least partially towards its initial closed position, thus partially blocking the pouring or shaking of the product from the container. Additionally, the necessity of providing either an rotatable cover or second hinged lid adds to the complexity and manufacturing cost for the end closures.

In an effort to prevent such push-open plastic end closure lids from springing back and partially blocking the pouring opening, certain prior art closures were provided with means for engaging the push-open lid and retaining it in its fill open position. One such example of such the is disclosed in U.S. Pat. No. 4,969,572 which utilizes a tab on the underside of the frangible lid. This tab, when pushed to its fully open position, engages a gripping member molded on the underside of the cover to lock the lid in its fully open position. However, in use it has been found that consumers may not push the lid to its fully open position so that the locking tab engages the gripping member. Additionally, a second cover means is required to close the container for storage after the frangible seal of the push-open lid has been broken.

Accordingly, alternative means for holding the push-open lid in an open position have been developed. One such alternative end closure is described in U.S. Pat. No. 5,167,338 in which the push-open lid has a tab extending opposite the lid opening such that when in an open position, the tab extends upward from the end closure, and engages with a rotating cover, thereby holding the push-open lid in an open position. While providing a solution to the problem of "memory" in the push-open lid hinge, this end closure still requires a two piece manufacture, as a rotating cover is needed to secure the lid in an open position and to close the container for subsequent storage.

BRIEF SUMMARY OF THE INVENTION

Among the several objects and features of the present invention may be noted the provision of a one-piece plastic closure for a container which has a push-open lid portion having a flexible hinge along portions of the perimeter thereof, and frangible lines of weakness defining the push-open lid;

The provision of such a closure in which the push-open lid is molded in place in the cover for sealing the contents of the container and which may be readily, manually broken away from the cover to permit access to contents of the container and to provide a tamper-evident seal;

The provision of such a closure having a locking tab which automatically snap locks the lid in its fully open position thereby to prevent the unintended partial reclosing of the lid which may in part block the flow of the contents from the container;

The provision of such a closure which provides a closing tab which projects upwardly from the closure when the lid is in its fully open position for enabling a person to readily re-close the lid;

The provision of such a closure which does not require either a rotatable cover or second lid to close and secure the push-open lid opening after the breaking of the frangible seal lines;

The provision of such a closure which utilizes a simple mold and which minimizes the amount of plastic required to form the closure;

The provision of such a closure which is economical to manufacture, which may be readily manufactured, which may be readily installed on a container, and which is easy for the consumer to use.

Other objects and features of this invention will be in part apparent and in part pointed out hereinafter.

Briefly stated, a one piece closure of the present invention is adapted to be installed on a container. The closure has a cover which has a break-open lid within the cover. The lid has a main lid portion defined by one or more lines of frangible weakness in the cover and a lid tab defined by one or more lines of frangible weakness in the cover. The lid is connected to the cover by a hinge line and the lid tab is integral with the main lid portion and is on the opposite side of the hinge line from the main lid. Upon the application of force to the main lid sufficient to break the frangible lines of weakness defining the maid lid and the lid tab, the main lid and the lid tab rotate about the hinge line with the main lid rotating downwardly out of the plane of the cover into the container toward a fully open position thus forming an opening in the cover through which a product within the container may be poured or shaken at the same time, the lid tab rotates upwardly out of the plane of the cover thereby to form a tab opening in the cover. The main lid has a locking tab on its underside so positioned on the underside of the lid that upon the main lid being rotated downwardly into the container substantially to its fully opened position, the locking tab cooperates with a portion of the cover thereby to hold the main lid in its fully open position. With the lid in its fully open position, upon the application of a closing force to the closing tab, the locking tab moves out of the cooperation with the cover and permits the main lid and the lid tab to rotate about the hinge line back to a closed position in which the main lid and the lid tab are substantially co-planar with the cover thus substantially closing the main and tab openings in the cover.

BRIEF DESCRIPTION OF THE SEVERAL VIEWS OF THE DRAWINGS

Corresponding reference characters indicate corresponding parts throughout the several views of the drawings.

DETAILED DESCRIPTION OF THE INVENTION

Figure 1:
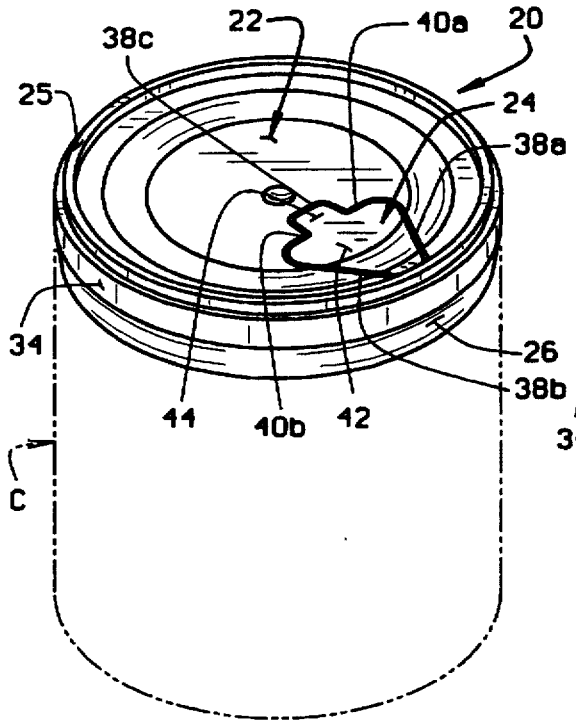
FIG. 1 is a perspective view of a closure of the present invention installed on a container (shown in phantom) with a break away lid formed within the closure being in a closed position.

Referring now to the drawings, a closure of the present invention is illustrated in its entirety by reference character 20. The closure is shown to be a so-called one-piece closure and it is mounted on one end of a shake and pour container C (as shown in phantom in FIGS. 1 and 2). Closure 20 includes a cover, as generally indicated at 22, and a break-open lid 24 for opening and closing access to the contents of the container C.

Figure 3:
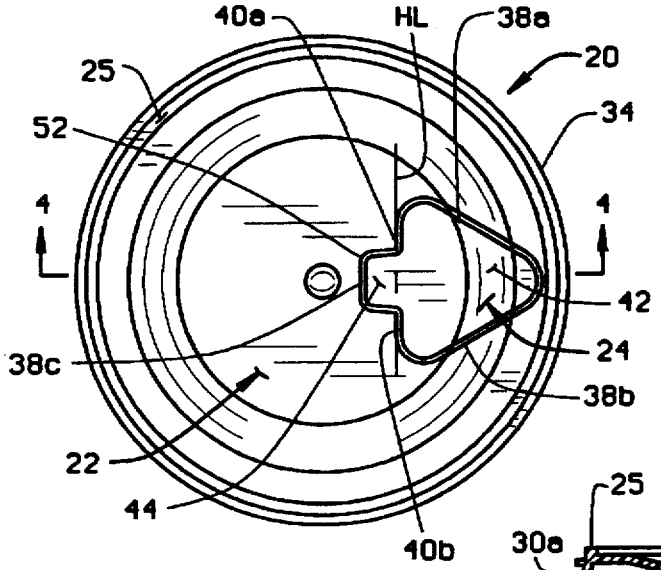
FIG. 3 is a top plan view of the closure.
Figure 4:
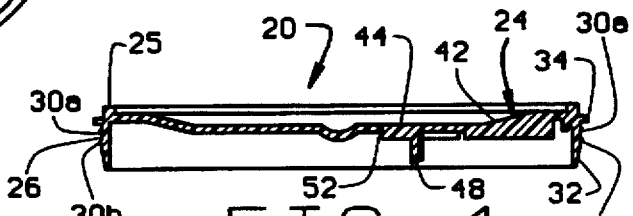
FIG. 4 is a cross-sectional view taken along line 4—4 in FIG. 3.

More particularly, closure 20 is a one-piece member (as best shown in FIG. 3) molded of a suitable synthetic resin material (e.g., a polystyrene or a polyethylene resin such as HMA 047/HDPE commercially available from Mobil Oil Corporation of Fairfax, Va. As mentioned, closure 20 has a generally planar cover 22 (which also may be referred to as a center plate or face). In alternate embodiments, cover 22 may be somewhat concave or convex, or it may have shoulders or flanges defining different levels on the center plate. Cover 22 further has an upwardly extending reinforcing rim 25 and a downwardly extending skirt 26. The outer perimeter of skirt 26 is sized to fit snugly within an open end of container C and is provided with one or more peripheral ribs 30A, 30B (as best shown in FIG. 4) to aid in retaining closure 20 in place on container C. To further facilitate the installation of closure 20 into the open end of container C, the lower portion of the skirt 26 is beveled, as indicated at 32 (see FIG. 4). The closure 20 of the present invention is installed in container C in the conventional manner and a suitable commercially available adhesive, such as No. 287-337, (not shown) is preferably applied to the outer surface of the skirt 26 so as to sealably secure the closure 20 to the open end of container C. Further, an outwardly extending flange 34 is positioned around the upper portion of skirt 26 such that when the skirt 26 is inserted into container C, the flange 34 bears against the upper edge of the container C and acts as a stop to limit the insertion of the closure 20 into the container.

Figure 5:
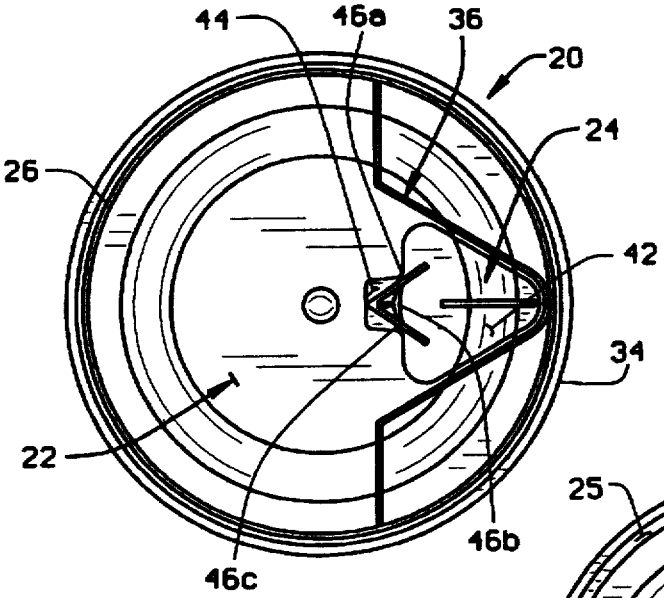
FIG. 5 is a bottom plan view of the closure illustrating stiffening ribs reinforcing the cover and the break away lid.

As shown in FIG. 5, the underside of cover 22 is provided with an integral reinforcing rib 36 to strengthen or stiffen the cover, particularly in the area surrounding break open lid 24. Integral reinforcing rib 36 is molded directly onto the underside of the cover 22 as a continuous piece. It is recognized that alternative configurations of the reinforcing rib 36 may be employed on the closure 20 without detracting from the invention disclosed herein.

Figure 2:
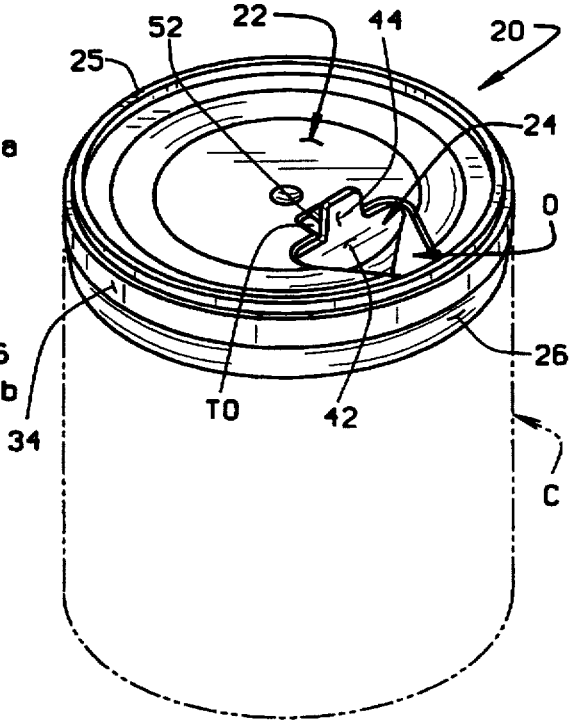
FIG. 2 is a perspective view of the closure of the present invention with the lid broken away from a cover portion of the closure and with the lid in an open position.

In accordance with this invention, break open lid 24 is integrally formed in the cover 22 of closure 20. More particularly, the break open lid 24 is defined by perimeter frangible or break away lines 38A, 38B, 38C and molded-in-place hinges 40A and 40B. As shown, hinges 40A and 40B are inline with one another, and define a hinge line HL about which the lid 24 may rotate between a closed position (as shown in FIG. 1) in which the lid 24 is substantially co-planar with the cover 22, and a fully open position (as shown in FIG. 2) in which a portion of the lid (referred to as the main lid portion 42) is rotated downwardly into the container and in which another portion of the lid (referred to as the closing tab 44) is rotated upwardly above the level of the cover 22 so as to enable closing of the closure 20 in a manner as will be hereinafter described.

Figure 8:
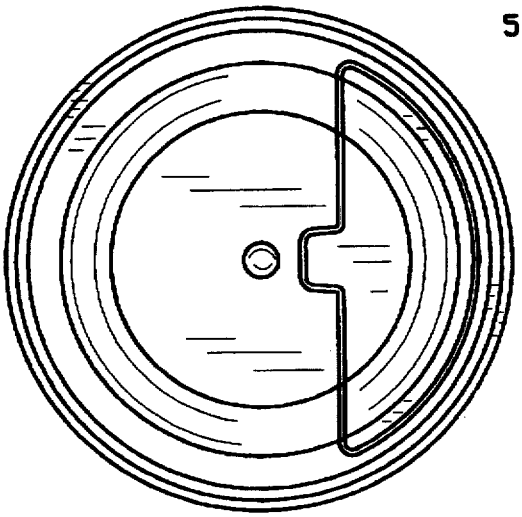
FIG. 8 is a top plan view of an alternate embodiment of the end closure having a lid of a different shape (i.e., part circular instead of generally triangular).

As shown in FIGS. 1–7, the lid 24 may be of a triangular shape, or, as shown in FIG. 8, may be of a part-circular shape suitable for product dispensing. Within the scope of this invention, the shape and size of the lid 24 is not critical. It will be understood that with molded-in-place hinges 40A and 40B, the lid 24 remains attached to the closure 20 even after the frangible (break away) lines of weakness are broken. Further, it is preferred that the hinges 40A and 40B are of substantially the same length, but within the broader aspects of this invention, only a single hinge line need be provided, and if more than one hinge is provided, the hinges need not be of equal length.

More specifically, the lid 24 comprises a main lid portion 42 and a closing tab 44 integrally molded together. The closing tab 44 is defined by the frangible perimeter line 38C. As shown, closing tab 44 and main lid 42 are disposed on opposite sides of the molded-in-place hinges 40A and 40B.

Figure 6:
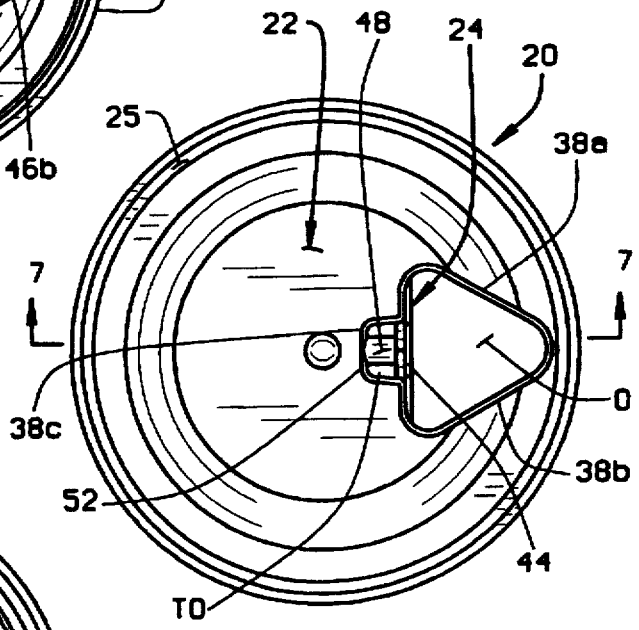
FIG. 6 is a top plan view of the closure with the break away lid shown in its open position.

In use, when sufficient manual downward pressure is applied to main lid 42 (as by a user manually applying a downward force with a finger or the like), the main lid 42 and the closing tab 44 will break free of the cover 22 along the frangible lines 38A, 38B, and 38C respectively, and will pivot as a unit around the hinges 40A and 40B on hinge line HL. The main lid 42 will rotate downwardly into the container C and the closing tab 44 will rotate upward above the plane of cover 22 (see FIG. 2). The main lid portion 42 will thus define a product dispensing opening O (as best shown in FIGS. 2 and 6) in cover 22 through which the product from within the container C may be poured or shaken. Simultaneously, upon closing tab 44 being broken free of the cover 22, the closing tab will form a corresponding tab opening TO (see FIG. 2) in cover 22 on the opposite side of hinge line HL from product dispensing opening 0. It will be appreciated that the edges of the openings O and TO are defined by the frangible lines 38A, 38B, and 38C. The underside of lid 24 is preferably (but not necessarily) provided with integral reinforcing spines 46A–46C (as shown in FIG. 5) molded directly onto the underside of the lid 24. These ridges provide support (stiffening) for the lid 24 sufficient to distribute the pressure required to break frangible lines 38A, 38B, and 38C without the lid 24 undergoing significant distortion. It will be understood that these reinforcements stiffen both the main lid 42 and the closing tab 44.

Figure 7:
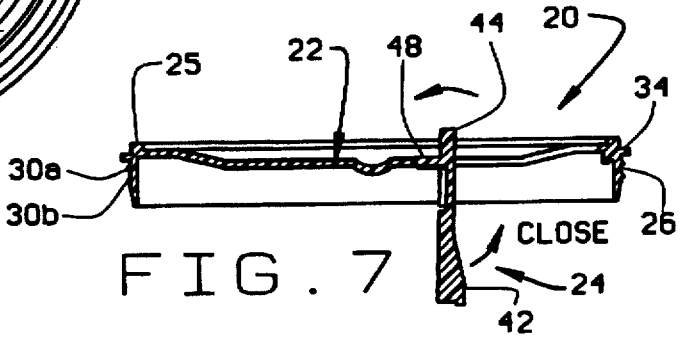
FIG. 7 is a cross-sectional view taken along line 7—7 in FIG. 6 showing a locking tab in engagement with an edge of the cover thus positively holding the lid in its fully open position and showing the closing tab in position to enable a user to readily re-close the lid by pressing on the raised closing tab.

A second tab, referred to as a locking tab 48, is formed integral with the underside of the lid 24, proximate hinge line HL, and is generally perpendicular to the plane of the lid. The locking tab 48 extends downwardly from the underside of the closing tab 44 (as shown in FIG. 4). The locking tab 48 is structurally reinforced by a portion of the integral reinforcing spines 46A–46C (see FIG. 5) and is of a length slightly longer than that of the closing tab 44. That is, the locking tab 48 extends downwardly from the underside of the lid 24 a distance somewhat greater than the length of closing tab 44 measured from the hinge line HL to the outer or free end of the closing tab. When the main lid 42 and closing tab 44 are broken clear of the cover 22 and rotated about hinge line HL to the fully open position (as shown in FIGS. 2 and 6), the locking tab 48 rotates upwardly about hinge line HL and contacts a locking edge 52 resulting from the breaking of the frangible line 40C, thus causing a deflection of the locking edge 52 such that the locking tab 48 snaps into place on locking edge 52, positively locking lid 24 in its fully open position (as shown in FIGS. 2 and 7). In this manner, the lid 24 is maintained in its fully open position by the locking tab 54 cooperating with the locking edge 58 and the natural tendency of the lid 24 as supported on the molded hinges 40A and 40B to return to its as molded, closed position is resisted. Thus, the lid of the present invention will be positively maintained in its fully open position and will not interfere with the dispensing of the product from the container via the product dispensing opening O.

To re-close the lid 24, pressure is manually exerted against the closing tab 44 in the direction of the arrow in FIG. 7 so as to rotate the closing tab toward its original closed position (as shown in FIGS. 1 and 4). Once sufficient pressure is exerted against the closing tab 44, the locking tab 48 will be forced past the locking edge 52, and both the main lid 42 and the closing tab 44 are free to rotate on hinge line HL back to their original closed positions in which both the main lid 42 and the closing tab 44 are substantially co-planar with respect to the cover 22. Once the main lid 42 and the closing tab 44 are substantially in their above-said closed positions, the edges of the main lid 42 and of the closing tab 44 at least in part interfere with the frangible lines 38A, 38B, and 38C from which these parts were broken away from cover 22. The close fit of the main lid 42 and the closing tab 44 with their above-said respective frangible lines serve to hold the main lid and the closing tab substantially in their closed positions, thus re-closing openings O and TO in the cover 22. A container C equipped with the closure 20 of this invention may thus be opened and re-closed numerous times merely be exerting sufficient pressure to force the various components out of and into contact, as above described. It will also be noted that with locking tab 48 snapped into locking engagement with locking edge 52 of cover 22 such that the lid 24 is positively held in its fully open position. Thus, even though the lid 24 may be biased to move from its fully open position toward a partially closed position because of memory or spring back of the hinges 40A and 40B, the locking tab holds the lid in its fully open position. Thus, the lid of this invention does not interfere with the pouring or shaking of product from opening O and yet the closure 20 and the re-closable lid 24 are of one-piece construction.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

I claim:

1. A one piece closure for a container, said closure having a cover, a break-open lid within said cover, said lid having a main lid defined by one or more lines of frangible weakness in said cover and a lid tab defined by one or more lines of frangible weakness in said cover, said lid being connected to said cover by a hinge line, said lid tab being integral with said main lid and being on the opposite side of said hinge line from said main lid, upon the application of force to said main lid portion sufficient to break said frangible lines of weakness defining said maid lid and said lid tab being broken free of said cover and enabling rotation of said main lid and said lid tab about said hinge line with said main lid rotating downwardly into said container toward its fully open position thus forming an opening in said cover through which a product within said container can be poured or shaken and with said lid tab rotating upwardly out of the plane of said cover thereby to form a tab opening in said cover, said main lid having a locking tab on its underside so positioned relative to said hinge line that upon said main lid being rotated downwardly into said container substantially to its fully opened position, said locking tab cooperates with a portion of said cover defining said tab opening therein formed by said lid tab thereby to hold said main lid in its fully open position, and upon applying a closing force to said tab, said locking tab moves out of said cooperation with said cover and permits said main lid and said lid tab to rotate back to a closed position in which said main lid and said lid tab are substantially co-planar with said cover thus substantially closing said openings in said cover.

2. The one piece closure of claim 1 wherein with said main lid and said lid tab re-closed, the edges of said main lid and said lid tab defined by said frangible lines of weakness cooperate with the adjacent portions of said cover to hold said main lid and said lid tab in substantially a co-planar position with respect to said cover.

3. The one-piece end closure of claim 1 wherein a means for support is integrally olded into the underside of said cover.

4. The one-piece end closure of claim 3 wherein said means for support is a molded reinforcing rib.

5. The one-piece end closure of claim 1 wherein a reinforcing member is integrally molded into the underside of said lid.

6. The one-piece end closure of claim 5 wherein said reinforcing member is a plurality of molded reinforcing ribs.

7. The one-piece end closure of claim 1 wherein said locking tab is of length longer than said closure tab.

8. The one-piece end closure of claim 7 wherein said locking tab has an reinforcing spine integrally molded thereon.

9. The one-piece end closure of claim 1 wherein the break-open lid is substantially triangular in shape.

10. The one-piece end closure of claim 1 wherein the break-open lid is substantially semi-circular in shape.

11. The one-piece end closure of claim 1 wherein said hinge means comprises two hinges of substantially equal length spaced co-linearly along a hinge line.

12. The one-piece end closure of claim 1 wherein said cover, said frangible weakness, said break open lid, said hinge means, said closing tab, and said locking tab are integrally molded out of plastic.

* * * * *

UNITED STATES PATENT AND TRADEMARK OFFICE

CERTIFICATE OF CORRECTION

PATENT NO : 5,894,950

DATED : April 20, 1999

INVENTOR(S) : Kick

It is certified that error appears in the above-identified patent and that said Letters Patent are hereby corrected as shown below:

Col. 6 Line 61, Claim 3
Replace "olded" with -- molded

Signed and Sealed this

Eighth Day of May, 2001

*Attest:*

Nicholas P. Godici

NICHOLAS P. GODICI

*Attesting Officer*

*Acting Director of the United States Patent and Trademark Office*